US008335465B2

(12) United States Patent
Tsuchida

(10) Patent No.: US 8,335,465 B2
(45) Date of Patent: Dec. 18, 2012

(54) IMAGE FORMING APPARATUS

(75) Inventor: Masami Tsuchida, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 1062 days.

(21) Appl. No.: 11/687,756

(22) Filed: Mar. 19, 2007

(65) Prior Publication Data

US 2007/0223981 A1 Sep. 27, 2007

(30) Foreign Application Priority Data

Mar. 24, 2006 (JP) ..... 2006-083645

(51) Int. Cl.
*G03G 15/00* (2006.01)

(52) U.S. Cl. ..... 399/381; 399/388; 399/391; 399/397; 399/405; 271/9.13; 271/65; 271/185; 271/225; 271/298; 271/301; 271/279

(58) Field of Classification Search ..... 399/381, 399/388, 391, 397, 405; 271/9.13, 65, 185, 271/225, 298, 301
See application file for complete search history.

(56) References Cited

U.S. PATENT DOCUMENTS 6,269,237 B1 * 7/2001 Olbrich et al. ..... 399/401
2006/0039728 A1 * 2/2006 deJong et al. ..... 399/381
2006/0039729 A1 * 2/2006 Mandel et al. ..... 399/381

FOREIGN PATENT DOCUMENTS

JP 07-209926 8/1995
JP 10-086455 4/1998
JP 2005-114760 4/2005

* cited by examiner

*Primary Examiner* — Judy Nguyen
*Assistant Examiner* — Andy Pham
(74) *Attorney, Agent, or Firm* — Renner, Otto, Boisselle & Sklar, LLP

(57) ABSTRACT

An image forming apparatus includes a first and a second image forming sections, a paper feeding section, and a paper output section. The image forming sections form an image on paper independently. The apparatus is laterally dividable into a first and a second portions where the first and second image forming sections are respectively positioned. The feeding section is arranged below the first image forming section in the first portion. The output section is arranged above the second image forming section in the second portion. The apparatus has two simple transport paths that run vertically through the image forming sections, respectively, without intersecting each other and detouring around the second or first image forming section.

11 Claims, 5 Drawing Sheets

IMAGE FORMING APPARATUS

CROSS REFERENCE

This Nonprovisional application claims priority under 35 U.S.C. §119(a) on Patent Application No. 2006-083645 filed in Japan on Mar. 24, 2006, the entire contents of which are hereby incorporated by reference.

BACKGROUND OF THE INVENTION

The invention relates to an image forming apparatus that includes a first image forming section, a second image forming section, a paper feeding section for feeding paper to each of the first and second image forming sections, and a paper output section for outputting paper on which an image is formed in each of the first and second sections.

As a type of electrophotographic image forming apparatus, a color image forming apparatus is known that is provided with a single image forming section that has toner of four colors, i.e., three subtractive primary colors and black, stored therein and performs both black-and-white and color image forming processes. In a color image forming process, this apparatus superimposes toner images of up to four colors and transfers the superimposed images to paper. In order to obtain a high-quality color image without any out-of-register colors, there is a limit to speed of image forming process. Thus, the color image forming apparatus provided with the single image forming section cannot fully satisfy consumer needs for faster black-and-white image forming processes.

JP H10-086455A discloses an image forming apparatus provided with two image forming sections. A second one of the image forming sections is provided to take over an image forming process in the event of failure of a first one of the image forming sections during the image forming process.

In this arrangement, as an example, the first image forming section may be used for black-and-white image formation, and the second image forming section for color image formation.

However, no conventional apparatus including the one disclosed in JP H10-086455A has a plurality of image forming sections, a paper feeding section, and a paper output section, arranged so as to form a shortest paper transport path.

In the apparatus as disclosed in JP H10-086455A, a paper transport path leading from the second image forming section to the paper output section is formed in such a manner as to detour paper around the first image forming section provided nearer to the paper output section. The bend in the transport path for paper on which an image is formed in the second image forming section to be transported on is likely to cause paper to be jammed or damaged.

Thus, the conventional apparatus cannot provide both of fast black-and-white image forming processes and high-quality color image forming processes. This problem also occurs in an image forming apparatus, of other type than an electrophotographic image forming apparatus, such as an inkjet image forming apparatus, that is provided with a plurality of image forming sections.

A feature of the invention is to provide an image forming apparatus that has a plurality of image forming sections, a paper feeding section, and a paper output section, arranged in such a manner as to render paper transport paths as simple as possible, thereby enabling both fast black-and-white image formation and high-quality color image formation.

SUMMARY OF THE INVENTION

An image forming apparatus according to an aspect of the invention includes a first and a second image forming sections, a paper feeding section, and a paper output section. The first and second image forming sections form an image on paper independently of each other. The paper feeding section feeds paper to each of the first and second image forming section. To the paper output section, paper on which an image is formed in each of the first and second image forming sections is output. The apparatus is laterally dividable into a first portion and a second portion where the first and second image forming sections are respectively positioned. The paper feeding section is arranged below the first image forming section in the first portion. The paper output section is arranged above the second image forming section in the second portion. The apparatus has two simple transport paths that run vertically through the first and second image forming sections, respectively, without intersecting each other or detouring around the second or first image forming section.

DETAILED DESCRIPTION OF THE INVENTION

Figure 1:
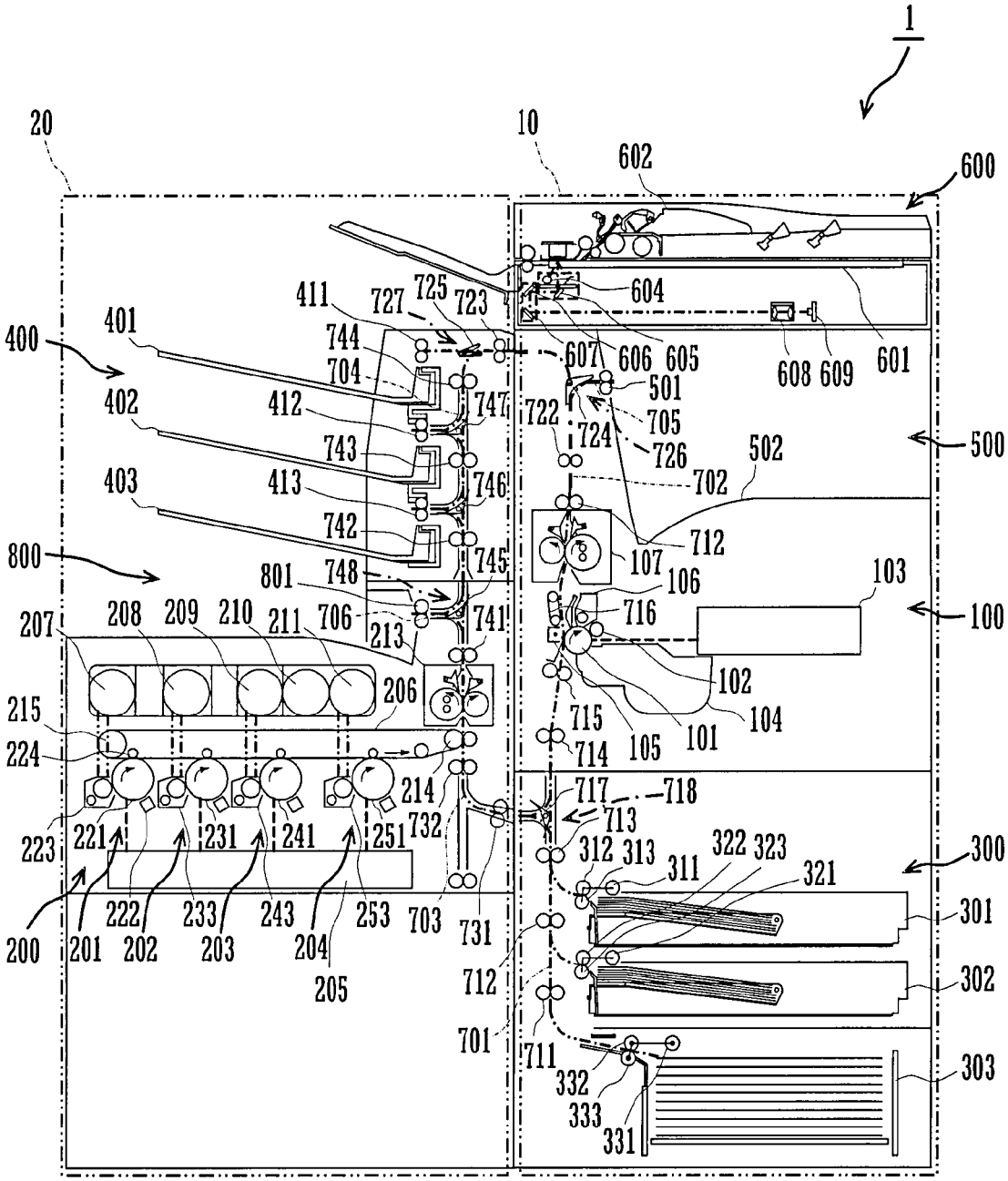
FIG. 1 is a vertical cross-section of an image forming apparatus according to a first embodiment of the invention.

With reference to the accompanying drawings, preferred embodiments of the invention will be described below. FIG. 1 is a vertical cross-section of an image forming apparatus 1 according to a first embodiment of the invention. The apparatus 1 includes a first image forming section 100, a second image forming section 200, a paper feeding section 300, a first paper output section 400, a second paper output section 500, a scanner section 600, and a switchback section 800. The apparatus 1 also has first to sixth transport paths 701 to 706 formed therein.

The first path 701 is formed between the section 300 and the section 100. The second path 702, connected to the path 701, is formed between the section 100 and the section 400. The third path 703 is formed between a midway point of the path 701 and the section 200. The fourth path 704, connected to the path 703, is formed between the section 200 and a midway point of the path 702. The fifth path 705 is formed between the midway point of the path 702 and the section 500. The sixth path 706 is formed between a midway point of the path 704 and the section 800.

The apparatus 1 can be laterally divided into a first portion 10 (on the right side in the figure) and a second portion 20 (on the left side). In the portion 10, the scanner section 600, the paper output section 500, the first image forming section 100, and the paper feeding section 300 are arranged in that order, from top to bottom. In the portion 20, the paper output section 400 and the image forming section 200 are arranged, with the section 400 above the section 200.

The section 600 has a glass platen 601, an automatic document feeder 602, a light source 604, reflecting mirrors 605 to 607, an optical lens 608, and a charge coupled device (CCD) 609. The source 604 irradiates with light a document placed on the platen 601 or being transported on the platen 601 by the feeder 602. The mirrors 605 to 607 reflect the reflected light from the document, toward the lens 608. The lens 608 focuses the reflected light on the CCD 609. The CCD 609 outputs an electric signal according to the reflected light.

The section 100 serves to form a black-and-white image on paper. The section 100 has a photoreceptor drum 101, a charging device 102, a laser scanning unit 103, a developing device 104, a transfer device 105, a cleaner 106, and a fusing device 107. The drum 101 is rotatable at a predetermined speed in a direction indicated by an arrow. Along the rotational direction of the drum 101, the devices 102, 104, and 105 and the cleaner 106 are arranged in that order.

The device 102 applies to an outer circumferential surface of the drum 101 such a voltage as to allow the surface to have a uniform electric potential. The unit 103 irradiates the surface of the drum 101 with laser light modulated according to image data, so that an electrostatic latent image is formed on the surface. The device 104 stores black toner therein, and supplies the black toner to the surface of the drum 101 to develop the electrostatic latent image on the drum 101 into a black toner image. The device 105 is located opposite the drum 101 in a transfer position in the path 701. The device 105 transfers the toner image on the drum 101 to a surface of paper. After the toner image is transferred from the drum 101 to the paper, the cleaner 106 removes toner debris on the drum 101. The device 107, located in a fusing position in the path 701, heats and pressurizes the paper. Thus, the black toner image is firmly fixed to the paper as a black-and-white image.

The section 200 serves to form a color image on paper. The section 200 has processing sections 201 to 204, a laser scanning unit 205, an intermediate transfer belt 206, toner hoppers 207 to 211, a second transfer device 212, and a fusing device 213.

The unit 205 irradiates the sections 201 to 204 with laser light modulated according to respective image data of yellow, magenta, cyan, and black colors obtained by color separation of an original color image.

The belt 206 is an endless belt looped over rollers 214 and 215. While traveling, the belt 206 passes through the sections 201 to 204 in that order. The hoppers 207 to 209 store therein toner of yellow, magenta, and cyan colors, respectively. The hoppers 210 and 211 store therein black toner.

The sections 201 to 204 serve to form yellow, magenta, cyan, and black toner images, respectively. The section 201 has a photoreceptor drum 221, a charging device 222, a developing device 223, and a first transfer device 224. The drum 221 is rotatable at a predetermined speed in a direction indicated by an arrow. Along the rotational direction of the drum 221, the devices 222, 223, and 224 are arranged in that order.

The device 222 applies to an outer circumferential surface of the drum 221 such a voltage as to allow the surface to have a uniform electric potential. The unit 205 irradiates the surface of the drum 221 with laser light modulated according to image data of yellow color, so that an electrostatic latent image is formed on the surface. The device 223 holds therein yellow toner supplied from the hopper 207. The device 223 supplies the yellow toner to the surface of the drum 221 to develop the electrostatic latent image on the drum 221 into a yellow toner image. Positioned opposite the drum 221 through the belt 206, the device 224 transfers the toner image on the drum 221 to a surface of the belt 206.

Each of the sections 202 to 204 is similar in configuration to the section 201. A developing device 233 holds therein magenta toner supplied from the hopper 208. A developing device 243 holds therein cyan toner supplied from the hopper 209. A developing device 253 holds therein black toner supplied from the hopper 210 or 211. The unit 205 irradiates a surface of a photoreceptor drum 231 with laser light modulated according to image data of magenta color. The unit 205 irradiates a surface of a photoreceptor drum 241 with laser light modulated according to image data of cyan color. The unit 205 irradiates a surface of a photoreceptor drum 251 with laser light modulated according to image data of black color.

To the surface of the belt 206, yellow, magenta, cyan, and black toner images are sequentially transferred, and accumulated in proper alignment, in the sections 201 to 204, respectively. After passing through the sections 201 to 204, thus, the belt 206 has a full-color toner image formed thereon by subtractive color mixture.

The device 212 is located opposite the roller 214 through the belt 206 in a transfer position in the path 703. Paper is passed between the device 212 and the belt 206. The device 212 transfers the full-color toner image on the belt 206 to a surface of the paper. The device 213, located in a fusing position in the path 703, heats and pressurizes the paper. Thus, the full-color toner image is firmly fixed to the paper as a color image.

The paper feeding section 300 has paper cassettes 301 to 303, pick-up rollers 311, 321, and 331, feeding rollers 312, 322, and 332, and friction rollers 313, 323, and 333. Each of the cassettes 301 to 303 stores therein a plurality of sheets of paper of a single size.

Rotation of the rollers 311, 312, and 313 feeds a top one of the paper sheets stored in the cassette 301 into the path 701. Rotation of the rollers 321, 322, and 323 feeds a top one of the paper sheets stored in the cassette 302 into the path 701. Rotation of the rollers 331, 332, and 333 feeds a top one of the paper sheets stored in the cassette 303 into the path 701.

In the path 701, transport rollers 711 to 714, registration rollers 715, a transport belt 716, and a flapper 717 are arranged. The rollers 711 to 714 deliver, to the image forming section 100, paper fed from the cassettes 301 to 303. The rollers 715 lead paper between the drum 101 and the device 105 in synchronization with rotation of the drum 101. The belt 716 leads paper that has passed between the drum 101 and the device 105, into the fusing device 107. The flapper 717, located at a diverging point 718, selectively allows passage of paper on the path 701 or 703.

In the path 702, transport rollers 721 to 723 and flappers 724 and 725 are arranged. The rollers 721 lead paper from the fusing device 107 into the path 702. The rollers 722 and 723 deliver paper to the first paper output section. The flapper 724, located at a diverging point 726, selectively allows passage of paper on the path 702 or 705. The flapper 725, located at a diverging point 727, selectively allows passage of paper on the path 702 or 704.

As described earlier, the path 705 is formed between the midway point of the path 702 and the second paper output section 500. The section has paper output rollers 501 and a paper output tray 502. The rollers 501 output paper guided in the path 705, to the tray 502. Depending on the number of output paper sheets, the tray 502 is moved up and down by an elevating mechanism (not shown).

In the path 703, transport rollers 731 and registration rollers 732 are arranged. The rollers 731 guide into the second image forming section 200 paper that has passed through the point 718. The rollers 732 lead paper between the belt 206 and the second transfer device 212 in synchronization with rotation of the belt 206.

The path 704 is formed approximately vertically in the section 400. The section 400, which has a multi-tiered structure, includes paper output trays 401 to 403 and paper output rollers 411 to 413. In the path 704, transport rollers 741 to 744 and flappers 745 and 747 are arranged. The rollers 741 to 744 transport paper that has passed through the device 213. The flappers 746 and 747 lead paper to the rollers 413 and 412, respectively. The rollers 413 and 412 output paper to the trays 402 and 403, respectively. The rollers 411 lead paper that has been guided into the path 702 from the point 727 by the flapper 725, to the tray 401. The rollers 411 output paper to the tray 401.

As described earlier, the path 706 is formed between the midway point of the path 704 and the switchback section 800. The section 800, which corresponds to the third paper output section of the Claims, has switchback rollers 801. The flapper 745, located at a diverging point 728, selectively allows passage of paper on the path 704 or 706. While nipping therebetween a tail end of paper guided into the path 706 from the point 728, the rollers 801 are rotated in a forward direction and then in a reverse direction. Thus, the paper is reversed and sent back to the path 704.

The section 100 has a faster processing speed than that of the section 200. Thus, the section 100 is used for forming black-and-white images on a large number of paper sheets. In black-and-white image formation by the section 100, the flapper 717 at the point 718 allows passage of paper on the path 701. Paper stored in the cassettes 301 to 303 provided in the paper feeding section 300 is transported to the section 100 by the path 701.

Paper with a black-and-white image formed in the section 100 is sent to the top of the section 400 by the path 702. Under normal conditions, the flapper 725 at the point 727 allows passage of paper on the path 702 leading to the rollers 411. Thus, the paper is output to the tray 401 with an image-bearing side facing up.

The three-tiered trays 401 to 403 provided in the section 400 allows sorting of a plurality of paper sheets with black-and-white images formed. In this case, the flapper 725 at the point 727 allows passage of paper on the path 704 as appropriate so that the paper is guided from the path 702 into the path 704. In the path 704, the flappers 747 and 746 allow passage of paper to the rollers 412 and 413, respectively, as appropriate. Thus, the paper sheets with black-and-white images formed in the section 100 are transported downward on the path 704 and selectively output to the trays 401 to 403.

When paper with a black-and-white image formed in the section 100 is to be output with an image-bearing side facing down in a situation such as when an image forming process is performed in printer mode, the flapper 724 at the point 726 allows passage of paper on the path 705. Thus, paper with a black-and-white image formed in the section 100 is guided from the path 702 into the path 705 and then output to the tray 502, with an image-bearing side facing down, by the rollers 501.

In a case in which a plurality of paper sheets with black-and-white images formed in the section 100 need to be sorted with image-bearing sides facing down, the flapper 724 is set to allow passage of paper on the path 705. Paper with a black-and-white image formed in the section 100 is thus guided from the path 702 into the path 705. Then, the rollers 501 are rotated in the reverse direction while nipping a tail end of the paper therebetween, so that the paper is sent back to the path 702, the tail end first. Thus, the paper is transported upside down to the section 400 by the path 702. The flappers 725, 747, and 746 sequentially allow passage of paper to the rollers 411, 412, and 413, respectively, so that the paper sheets with black-and-white images formed in the section 100 are sequentially output to the trays 401 to 403, with the image-bearing sides facing down.

In color image formation by the section 200, the flapper 717 at the point 718 allows passage of paper on the path 703. Paper stored in any one of the cassettes 301 to 303 provided in the paper feeding section 300 is transported by the path 701 and then the path 703 to the section 200, where a color image is formed on the paper. The paper with the color image formed is transported upward on the path 704 and output to the tray 401 with an image-bearing side facing down. When a plurality of paper sheets with color images formed are to be sorted and output, the flappers 725, 747, and 746 sequentially allow passage of paper to the rollers 411, 412, and 413, respectively, so that the paper sheets with color images formed in the section 200 are sequentially output to the trays 401 to 403, with the image-bearing sides facing down.

When a plurality of paper sheets with color images formed is to be output with image-bearing sides facing up, the flapper 745 at the point 748 is set to allow passage of paper on the path 706. Each sheet with a color image formed in the section 200 is guided to the switchback section 800 by the path 704 and then the path 706. The paper is reversed by the switchback rollers 801 and then transported upward on the path 704. The flappers 725, 747, and 746 sequentially allow passage of paper to the rollers 411, 412, and 413, respectively, so that the paper sheets with color images formed in the section 100 are sequentially output to the trays 401 to 403, with the image-bearing sides facing up.

It is to be noted that paper with a color image formed in the section 200 can be output with an image-bearing side facing up by being transported to the second paper output section 500 by the paths 704, 702, and 705 in that order.

It is also to be noted that the section 200 is capable of forming a black-and-white image by performing an image forming process only in the processing section 204 while halting image forming processes in the processing sections 201 to 203. Thus, the section 200 can form a black-and-white image in the event of a malfunction in the section 100, although the section 200 has a slower image forming speed than that of the section 100.

Further, it is possible to provide in the section 800 a post-processing unit for performing a post-process such as of stapling or punching paper. With such unit provided, post-processed paper is output to the section 800.

In the apparatus 1, as described so far, the first image forming section 100 is arranged above the paper feeding section 300 in the right-side portion 10, and the paper output section 400 is arranged above the second image forming section 200 in the left-side portion 20. This arrangement allows the paths 701 to 704 to form simple transport paths, without intersections or detours, for outputting paper fed from the section 300 to the section 400 after an image is formed on the paper in either one of the sections 100 and 200. This enables high-speed formation of both black-and-white and color images without causing damage to paper and paper jam.

Also, provision of the second paper output section 500 in addition to the first paper output section 400 not only ensures effective use of space, but also allows the sections 400 and 500 to output paper with image-bearing sides facing differently from each other.

Figure 2:
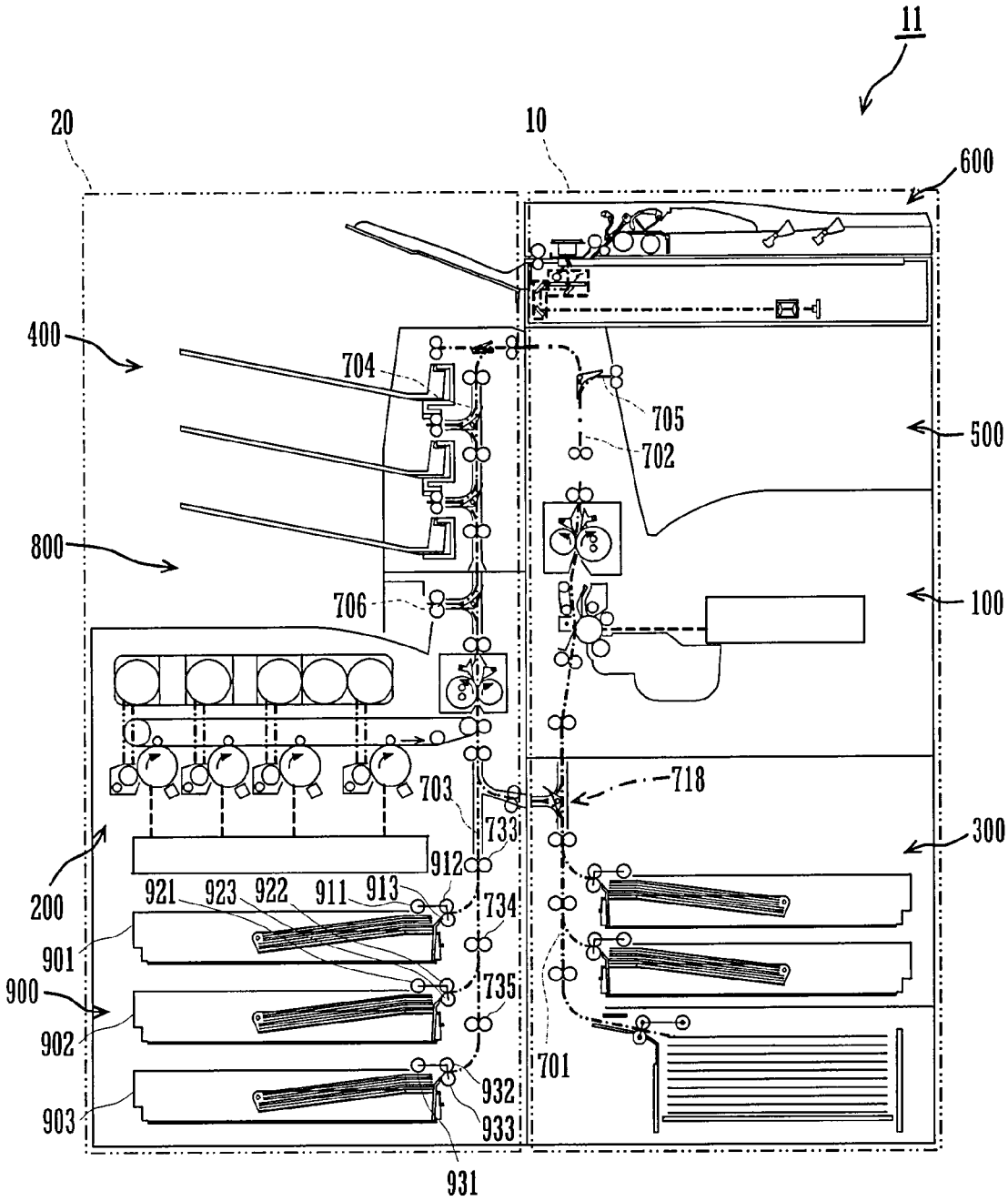
FIG. 2 is a vertical cross-section of an image forming apparatus according to a second embodiment of the invention.

FIG. 2 is a vertical cross-section of an image forming apparatus 11 according to a second embodiment of the invention. The apparatus 11 includes a second paper feeding section 900 in addition to the elements of the apparatus 1. The section 900 is arranged below the second image forming section 200 in the left-side portion 20.

The section 200 is a tandem-type color image forming section that has four photoreceptor drums 221, 231, 241, and 251 horizontally aligned with one another, and is short in height. Thus, there is sufficient space below the section 200 for positioning the section 900. Besides the section 900, the apparatus 11 has the path 703 extended downward, and transport rollers 733 to 735.

The section 900 has three-tier paper cassettes 901 to 903, pick-up rollers 911, 921, and 931, feeding rollers 912, 922, and 932, and friction rollers 913, 923, and 933. Each of the cassettes 901 to 903 stores therein a plurality of sheets of paper of a single size.

Rotation of the rollers 911, 912, and 913 feeds a top one of the paper sheets stored in the cassette 901 into the path 703. Rotation of the rollers 921, 922, and 923 feeds a top one of the paper sheets stored in the cassette 902 into the path 703. Rotation of the rollers 931, 932, and 933 feeds a top one of the paper sheets stored in the cassette 903 into the path 703.

Paper fed into the path 703 is transported upward to the section 200 by the rollers 733 to 735. In the apparatus 11, paper stored in the section 900 undergoes image forming process solely in the section 200. However, formation of a path connecting the path 703 to the path 701 below the diverging point 718 allows paper stored in the section 900 to undergo image forming process in the section 100.

Figure 3:
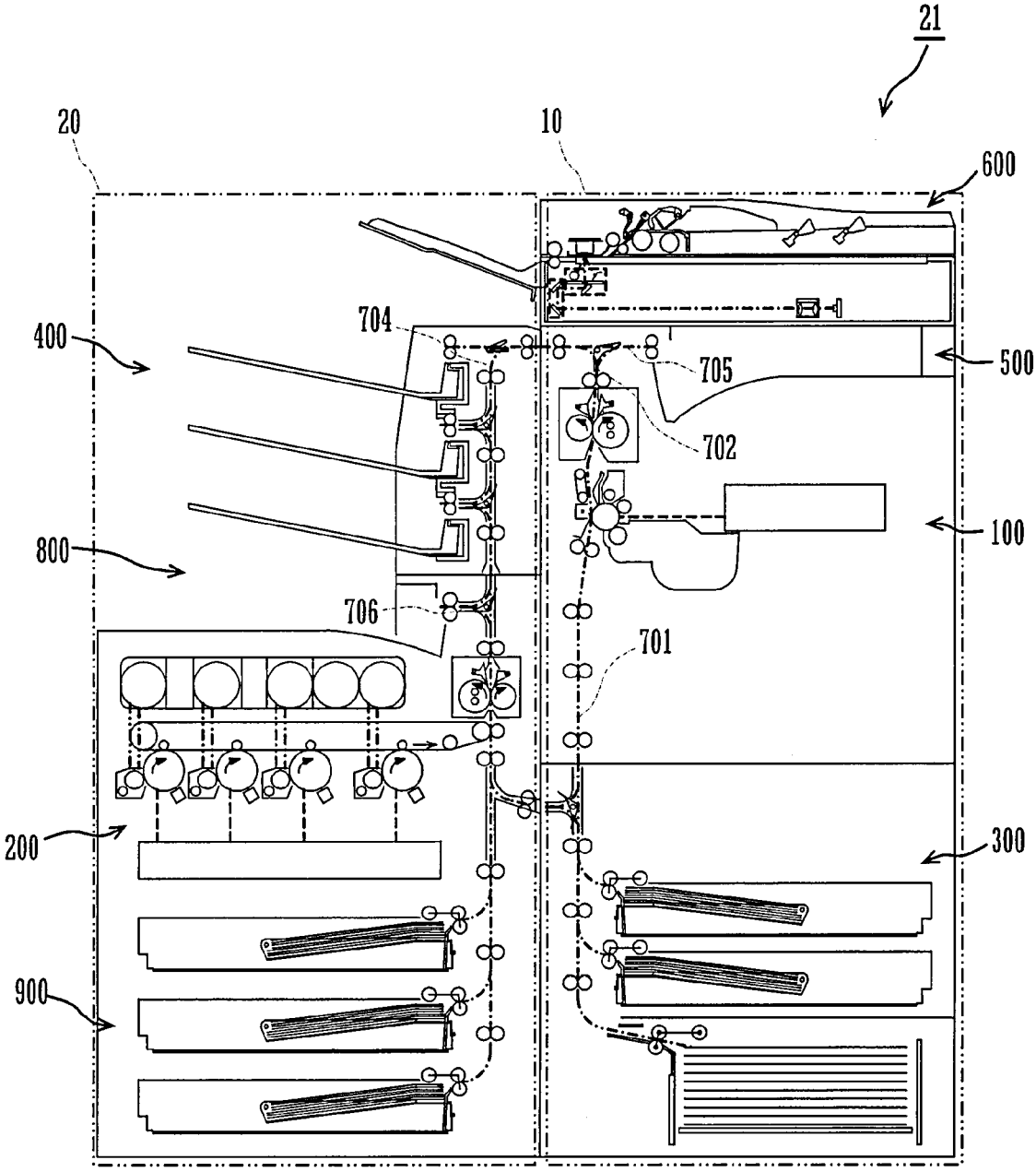
FIG. 3 is a vertical cross-section of an image forming apparatus according to a third embodiment of the invention.

FIG. 3 is a vertical cross-section of an image forming apparatus 21 according to a third embodiment of the invention. The apparatus 21 includes a vertically downsized version of the paper output section 500 provided in the apparatus 11. Despite a decreased capacity of the section 500, the apparatus 21 has a shorter paper transport distance from the section 200 to either one of the sections 400 and 800 through the paths 702, 704, and 706.

Figure 4:
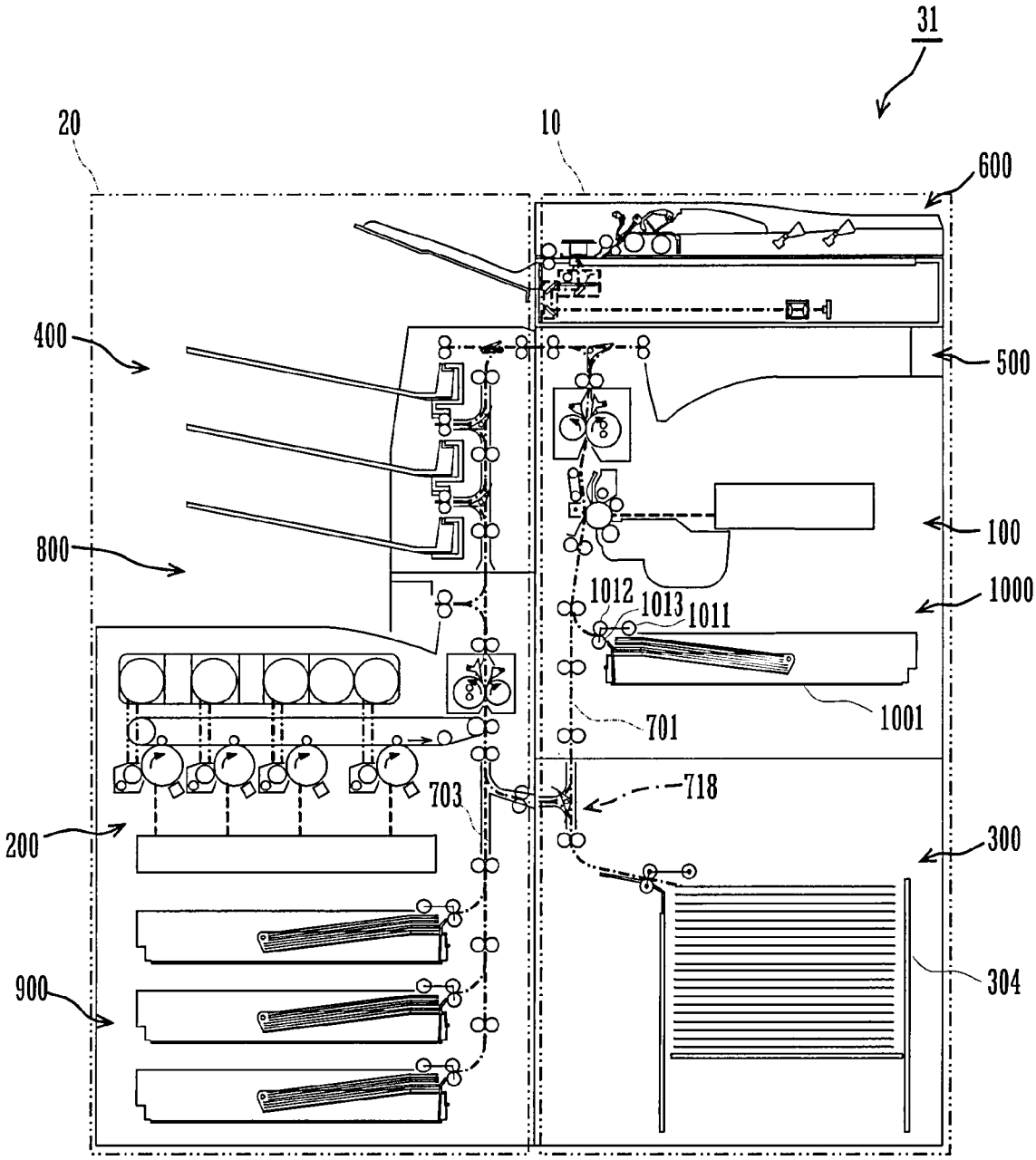
FIG. 4 is a vertical cross-section of an image forming apparatus according to a fourth embodiment of the invention.

FIG. 4 is a vertical cross-section of an image forming apparatus 31 according to a fourth embodiment of the invention. The apparatus 31 includes a third paper feeding section 1000 in addition to the elements of the apparatus 21. The section 1000 is arranged below the image forming section 100 and above the paper feeding section 300 in the right-side portion 10. The section 300 is provided with a large-capacity paper cassette 304.

The section 1000 has a paper cassette 1001, a pick-up roller 1011, a feeding roller 1012, and a friction rollers 1013. Rotation of the rollers 1011, 1012 and 1013 feeds a top one of the paper sheets stored in the cassette 1001 into the path 701.

Since paper fed from the cassette 1001 is guided above the diverging point 718 of the path 701, the paper cannot be transported to the section 200 via the path 703. Thus, paper fed from the section 1000 undergoes image forming process solely in the section 100.

Figure 5:
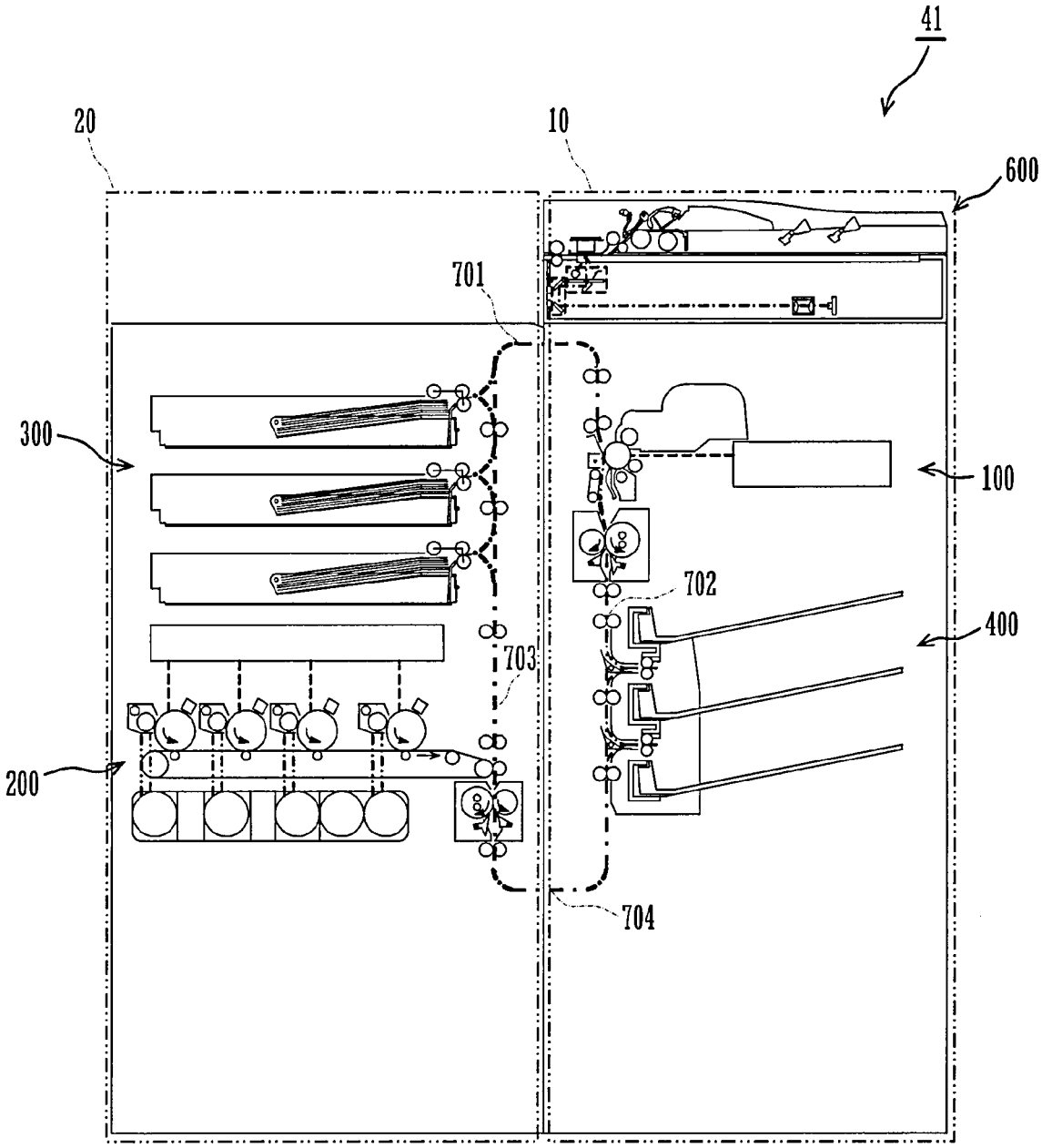
FIG. 5 is a vertical cross-section of an image forming apparatus according to a fifth embodiment of the invention.

FIG. 5 is a vertical cross-section of an image forming apparatus 41 according to a fifth embodiment of the invention. In the portion 10 of the apparatus 41, the scanner section 600, the first image forming section 100, and the paper output section 400 are arranged in that order, from top to bottom, while in the portion 20 the paper feeding section 300 and the second image forming section 200 are arranged with the section 300 above the section 200.

The path 701 is formed between the section 300 and the section 100. The path 702 is formed between the section 100 and the section 400. The path 703 is formed between the section 300 and the section 200. The path 704 is formed between the section 200 and the section 400.

Thus, the apparatus 41 also has a structure in which the sections 200 and 400 are arranged diagonally opposite the sections 100 and 300, respectively. A pair of the paths 701 and 702 that leads from the section 300 to the section 400 through the section 100 and a pair of the paths 703 and 704 that leads from the section 200 to the section 400 through the section 200 are formed without intersecting with each other and detouring around the sections 100 and 200. In other words, the apparatus 41 has two simple transport paths running through the sections 100 and 200, respectively.

However, a paper transport direction from the section 300 to the section 100 is opposite to that from the section 300 to the section 200, and this makes the configurations of the paths 701 and 703 within the section 300 complicated.

Alternatively, a second paper output section may be provided between the sections 100 and 400 by arranging the section 400 at a lower position in the portion 10.

Further alternatively, a second paper feeding section may be provided between the sections 600 and 100 by arranging the section 400 at a lower position in the portion 10.

Further alternatively, a third paper feeding section may be provided between the sections 300 and 200 by arranging the section 200 at a lower position in the portion 20.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus configured for operation in a horizontal orientation and laterally dividable in a horizontal direction into a first portion and a second portion, the image forming apparatus comprising:

a first image forming section, positioned in the first portion, for forming an image on paper;

a second image forming section, positioned in the second portion, for forming an image on paper independently of the first image forming section;

a first paper feeding section for feeding paper to each of the first and second image forming sections, the first paper feeding section positioned directly below the first image forming section in the first portion in a vertical direction perpendicular to the horizontal direction;

a first paper output section for outputting paper on which an image is formed in each of the first and second image forming sections, the first paper output section positioned directly above the second image forming section in the vertical direction;

a second paper output section positioned directly above the first image forming section;

a first transport path for transporting paper from the first paper feeding section to the first image forming section;

a second transport path for transporting paper from the first paper feeding section to the second image forming section;

a third transport path, connected to the first transport path, for transporting paper from the first image forming section to the first paper output section; and a fourth transport path, connected to the second transport path, for transporting paper from the second image forming section to the first paper output section, wherein:

the first image forming section is a black-and-white image forming section;

the second image forming section is a color image forming section;

the first transport path is arranged near a boundary between the first and second portions and in the first portion in the vertical direction;

the second transport path is arranged from the first portion to the second portion over the boundary;

the third transport path is arranged from the first portion to the second portion over the boundary;

the fourth transport path is arranged near the boundary and in the second portion in the vertical direction; and the first to fourth transport paths do not include an intersection or detour.

2. The image forming apparatus according to claim 1, wherein each of the first and second image forming sections:

performs an electrophotographic image forming process; and has a transfer position and a fusing position each arranged near a boundary between the first and second portions.

3. The image forming apparatus according to claim 1, wherein:

the second image forming section is a tandem color image forming section that has a plurality of photoreceptor drums for forming images of respective colors; and the photoreceptor drums are arranged in horizontal alignment with respective axial directions parallel to one another.

4. The image forming apparatus according to claim 3, wherein the first paper output section has a plurality of paper output trays arranged in tiers.

5. The image forming apparatus according to claim 3, further comprising a second paper feeding section positioned below the second image forming section.

6. The image forming apparatus according to claim 5, further comprising a third paper feeding section for feeding paper only to the first image forming section, the third paper feeding section positioned below the first image forming section.

7. An image forming apparatus configured for operation in a horizontal orientation and laterally dividable in a horizontal direction into a first portion and a second portion, the image forming apparatus comprising:

a first image forming section, positioned in the first portion, for forming an image on paper;

a second image forming section, positioned in the second portion, for forming an image on paper independently of the first image forming section;

a paper feeding section for feeding paper to each of the first and second image forming sections, the paper feeding section positioned directly above the first image forming section in the first portion in a vertical direction perpendicular to the horizontal direction;

a paper output section for outputting paper on which an image is formed in each of the first and second image forming sections, the paper output section positioned directly below the second image forming section in the second portion in the vertical direction;

a first transport path for transporting paper from the paper feeding section to the first image forming section;

a second transport path for transporting paper from the paper feeding section to the second image forming section;

a third transport path, connected to the first transport path, for transporting paper from the first image forming section to the paper output section; and a fourth transport path, connected to the second transport path, for transporting paper from the second image forming section to the paper output section, wherein:

the first image forming section is a black-and-white image forming section;

the second image forming section is a color image forming section;

the first transport path is arranged near a boundary between the first and second portions and in the first portion in the vertical direction;

the second transport path is arranged from the first portion to the second portion over the boundary;

the third transport path is arranged from the first portion to the second portion over the boundary;

the fourth transport path is arranged near the boundary and in the second portion in the vertical direction; and the first to fourth transport paths do not include an intersection or detour.

8. The image forming apparatus according to claim 1, wherein at least one of the first and second image forming sections is a color image forming section using an intermediate transfer method, which performs primary transfer and secondary transfer, and has a secondary transfer position located at a connection either between the first and third transport paths or between the second and fourth transport paths.

9. The image forming apparatus according to claim 1, wherein:

the paper output section has a plurality of paper output trays arranged in tiers; and the fourth transport path transports downward paper that has passed through the third transport path.

10. The image forming apparatus according to claim 8, wherein:

the paper output section has a plurality of paper output trays arranged in tiers; and the fourth transport path transports downward paper that has passed through the third transport path.

11. The image forming apparatus according to claim 1, wherein the first transport path and the fourth transport path are mutually vertically aligned in parallel.

* * * * *